US009191734B2

(12) United States Patent
Sporer et al.

(10) Patent No.: US 9,191,734 B2
(45) Date of Patent: Nov. 17, 2015

(54) LOUDSPEAKER

(75) Inventors: Thomas Sporer, Fuerth (DE); Daniel Beer, Martinroda (DE); Stephan Mauer, Ilmenau (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 787 days.

(21) Appl. No.: 13/210,420

(22) Filed: Aug. 16, 2011

(65) Prior Publication Data

US 2012/0008812 A1 Jan. 12, 2012

Related U.S. Application Data

(63) Continuation of application No. PCT/EP2010/051382, filed on Feb. 4, 2010.

(30) Foreign Application Priority Data

Feb. 16, 2009 (EP) ..... 09002148
Feb. 24, 2009 (DE) ..... 10 2009 010 278

(51) Int. Cl.
*H04R 9/06* (2006.01)
*H04R 1/26* (2006.01)
*H04R 1/40* (2006.01)

(52) U.S. Cl.
CPC *H04R 1/26* (2013.01); *H04R 1/403* (2013.01); *H04R 2201/401* (2013.01); *H04R 2205/022* (2013.01)

(58) Field of Classification Search
CPC ..... H04R 1/26; H04R 1/02; H04R 1/403; H03G 5/165
USPC ..... 381/335, 103, 332, 336, 337, 339, 345, 381/386
See application file for complete search history.

(56) References Cited

U.S. PATENT DOCUMENTS 2,602,860 A 7/1952 Doubt
4,399,328 A 8/1983 Franssen et al.
(Continued)

FOREIGN PATENT DOCUMENTS

DE 868 921 A2 3/1953
DE 695 07 896 T2 2/1999
(Continued)

OTHER PUBLICATIONS

Official Communication issued in corresponding Japanese Patent Application No. 2011-549523, mailed on Feb. 26, 2013.
(Continued)

*Primary Examiner* — Vivian Chin
*Assistant Examiner* — William A Jerez Lora
(74) *Attorney, Agent, or Firm* — Keating & Bennett, LLP

(57) ABSTRACT

A loudspeaker includes a two-dimensional array of non-housed individual speakers having flat shapes. The non-housed individual speakers are accommodated within a flat housing, the depth of the housing being smaller than 5 cm, for example. Non-housed individual speakers used are advantageously headphone capsules and/or miniature loudspeakers having diaphragm diameters of less than 5 cm.

25 Claims, 16 Drawing Sheets

(56) References Cited

U.S. PATENT DOCUMENTS

| | | | | |
|---|---|---|---|---|
| 6,801,631 | B1 | 10/2004 | North | |
| 2002/0146140 | A1 * | 10/2002 | Chiu | 381/332 |
| 2004/0151325 | A1 * | 8/2004 | Hooley et al. | 381/18 |
| 2005/0201583 | A1 | 9/2005 | Colich | |
| 2006/0159286 | A1 * | 7/2006 | Stiles et al. | 381/111 |
| 2008/0009741 | A1 * | 1/2008 | Hyuga | 600/459 |
| 2008/0085006 | A1 | 4/2008 | Leung | |

FOREIGN PATENT DOCUMENTS

| | | | |
|---|---|---|---|
| JP | 06-261385 | * | 9/1994 |
| JP | 06-261385 | A | 9/1994 |
| JP | 2004-531125 | A | 10/2004 |
| JP | 2005-130397 | A | 5/2005 |
| JP | 2008-109281 | A | 5/2008 |
| WO | 02/078388 | A2 | 10/2002 |
| WO | 2004/075601 | A1 | 9/2004 |
| WO | 2007/007083 | A1 | 1/2007 |

OTHER PUBLICATIONS

Official Communication issued in International Patent Application No. PCT/EP2010/051382, mailed on May 17, 2010.

English translation of Official Communication issued in corresponding International Application PCT/EP2010/051382, mailed on Aug. 18, 2011.

Beer, "Flachlautsprecher—ein Überblick (Flat-Panel Loudspeakers)", DAGA08 Trade Fair, Mar. 2008, Dresden, Germany.

Azima et al., "Distributed-Mode Loudspeakers (DML) in Small Enclosures", 106th AES Convention, May 8-11, 1999, Munich, Germany.

Beer et al., "The Air Spring Effect of Flat Panel Speakers", 124th AES Convention, May 17-20, 2008, Amsterdam, The Netherlands.

Wagner, "Electrostatic Loudspeaker—Design and Construction", Audio Amateur Press, 1993, Peterborough, New Hampshire.

Beer et al., "Flat Panel Loudspeaker Consisting of an Array of Miniature Transducers", 126th AES Convention of the Audio Engineering Society, May 7-10, 2009, pp. 1-9.

* cited by examiner rear view front view frequency partitioning of the array element into 3-way control;
LF – low-frequency, MF – mid-frequency, HF – high-frequency, X – short-circuited view with beveled chamfers rear view front view

| parameter | value |
|---|---|
| diameter | 41,60 mm |
| installation depth | 10,60 mm |
| diaphragm diameter | 36 mm |
| moving mass | 0,18 g |
| voice-coil height | 3,06 mm |
| voice-coil diameter | 18,76 mm |
| maximum linear diaphragm excursion | +/- 0,5 mm |
| minimum impedance | 49,50 Ω |
| nominal impedance | 50 Ω |
| DC resistance $R_{DC}$ | 53 Ω |
| voice-coil inductance L | 0,59 mH |
| force factor Bl(X) | 4,5 N/A |
| upper cutoff frequency (-6 dB) | 22000 Hz |
| lower cutoff frequency | depending on the housing |
| resonant frequency $f_s$ | 120 Hz |
| mechanical quality $Q_{ms}$ | 1,25 |
| electrical quality $Q_{es}$ | 0,41 |
| overall quality $Q_{ts}$ | 0,307 |
| equivalent air volume $V_{AS}$ | 0,661 |
| continuous output power (pink noise) | 300 mW |

FIGURE 6B

LOUDSPEAKER

CROSS-REFERENCE TO RELATED APPLICATIONS

This application is a continuation of co-pending International Application No. PCT/EP2010/051382, filed Feb. 4, 2010, which is incorporated herein by reference in its entirety, and additionally claims priority from European Applications No. EP 09002148.6, filed Feb. 16, 2009 and German Application No. 102009010278.7, filed Feb. 24, 2009, both of which are incorporated herein by reference in their entirety.

The present invention relates to sound reproduction systems and in particular to loudspeakers having a high sound reproduction bandwidth.

BACKGROUND OF THE INVENTION

Interest in flat-panel loudspeaker technologies has seen a marked increase in the last 10 years. Essentially, this is due to the increased space requirements of modern sound reproduction methods such as 5.1 surround or wave field synthesis, and to the diminishing installation space for loudspeakers in increasingly small and/or flat multimedia devices such as mobile phones and notebooks, for example. Utilization of flat-panel loudspeakers rather than conventional loudspeakers is to meet said increased requirements.

Investigations made on various flat-panel speaker technologies, which typically are as old as the cone loudspeakers by Kellogg and Rice, have shown that both utilization of non-housed flat-panel speakers directly on the wall and utilization of a flat loudspeaker housing entail considerable losses of sonic quality. Conventional technology may be found in Beer, D.: Flachlautsprecher—ein Überblick [*Flat-panel loudspeakers—an Overview*], presented at the DAGA08 trade fair, March 2008, Dresden; H. Azima, J. Panzer, "Distributed-Mode Loudspeakers (DML) in Small Enclosures", presented at the 106th AES Convention, Munich, Germany, May 1999; Beer et al.: The air spring effect of flat panel speakers, presented at the 124th AES Convention, May 2008, Amsterdam/The Netherlands; and Wagner, Roland: Electrostatic Loudspeaker—Design and Construction. Audio Amateure Press, Peterborough, N.H., 1993.

A non-housed flat-panel speaker typically is a dipole radiator having a low sound pressure level in the low-frequency tone range due to the acoustic short circuit. When such a dipole is installed near a wall, reflection and superposition of the rearward sound component with the portions of the sound that is emitted on the front side of the diaphragm, and diffraction effects associated therewith will lead to comb-filter-type sound coloration above the short-circuit frequency. It is for this reason that for conventional loudspeakers, loudspeaker housings are used. However, to preserve the advantage of a flat design, one uses flat housings that typically enclose a relatively small air volume. Just like with conventional speakers, too small an air volume will raise the fundamental resonant frequency of the sound transducer. Consequently, the lower cutoff frequency will also rise, which will result in reduced low-frequency tone reproduction.

US 2005/0201583 A1 discloses a low-frequency two-dimensional array based on a dipole principle. The system includes a support system having an open frame, several sub-woofers being accommodated in the open frame system in a dipole two-dimensional array configuration so as to provide controlled sound dispersion both in the horizontal and vertical planes. The sub-woofers are operable to provide low-frequency sound dispersion below about 300 Hz.

DE 695 07 896 T2 discloses a speaker device having controlled directional sensitivity and having a first set of at least three speakers arranged along a first straight line in accordance with a predetermined pattern, the distances from speaker to speaker being configured in a variable manner, and it also being possible for speakers to be arranged such that they are in contact with one another.

U.S. Pat. No. 2,602,860 discloses a speaker structure wherein nine conical speakers are symmetrically arranged, within one single frame, in three rows of three, respectively. The frame includes mutually tilted segments to increase the angle of radiation. For example, the distance between the edges of the speakers is to be smaller than the radius of the speakers, all of the speakers being operated from one same source. In addition, no restriction regarding movement of air is to be achieved by a housing, since this would adversely affect the performance at low frequencies.

U.S. Pat. No. 4,399,328 discloses a column, which is independent of direction and frequency, of electroacoustic transducers controlled using different amplitudes, so that specific conditions of the control operation of the electroacoustic transducers will result.

U.S. Pat. No. 6,801,631 B1 discloses a speaker system featuring several transducers positioned within a plane to achieve an optimum acoustic sound radiation pattern. Four central transducers (woofers) cooperate to reproduce the low and medium frequencies, the woofers being positioned such that no two woofers share a common vertical axis or a common horizontal axis. In addition, a fifth transducer, specifically a high-frequency tweeter, is provided which is arranged at a central location in between the woofers.

SUMMARY

According to an embodiment, a loudspeaker may have: an array consisting of non-housed individual speakers having flat shapes, the array being formed in the shape of a square and having a two-dimensional array consisting of a first two-dimensional sub-array and a second two-dimensional sub-array which have a further line array of flat-shaped individual speakers arranged between them in the form of a central array column of the array; a frequency-separator for providing a high-pass signal via a high-frequency tone path and a low-pass signal via a low-frequency tone path, the high-pass signal being used for controlling the further line array and the low-pass signal being used for controlling the first and second sub-arrays, all of the individual loudspeakers of the first and second sub-arrays being wired such that they are controlled via the low-frequency tone path by means of control signals that exhibit no mutual phase-shift apart from different line lengths, no phase shifter existing between the individual speakers and a driver output of the low-frequency tone path, and the individual speakers of the first and second sub-arrays being configured to provide low-frequency tone range in a multi-way system; a flat housing accommodating the individual speakers (11*a*, 11*b*, 11*c*), the flat housing having a front wall, a rear wall, and a side wall, and the flat housing having a depth of less than 5 cm, or a diaphragm diameter of a non-housed individual speaker of the two-dimensional array being smaller than 5 cm, and a distance smaller than 5 mm existing between edges of the non-housed individual speakers that are mutually adjacent, and a number of the non-housed individual speakers ranging from 9 to 49.

According to another embodiment, a loudspeaker may have: a two-dimensional array consisting of non-housed individual speakers having flat shapes; a flat housing accommodating the individual speakers, the flat housing having a front wall, a rear wall, and a side wall, and the flat housing having a depth of less than 5 cm, or a diaphragm diameter of a non-housed individual speaker of the two-dimensional array being smaller than 5 cm, and the individual speakers being grouped into larger groups of individual speakers and smaller groups of one or more individual speakers, of which adjacent ones of the larger groups of individual speakers are provided for reproducing spatially adjacent wave field synthesis channels having limited bandwidths below 1 kHz, and of which the smaller groups are provided for reproducing spatially adjacent wave field synthesis channels having signal components above 1 kHz, a distance between the larger groups being larger than a distance between the smaller groups.

According to another embodiment, a loudspeaker may have: a two-dimensional array consisting of non-housed individual speakers having flat shapes, said two-dimensional array having a first two-dimensional sub-array and a second two-dimensional sub-array; a further array consisting of individual speakers having flat shapes, said further array being arranged along a width of the front wall between the first two-dimensional sub-array and the second two-dimensional sub-array; a frequency-separator for providing a high-pass signal and a low-pass signal, the high-pass signal being used for controlling the further array and the low-pass signal being used for controlling the two-dimensional array; a flat housing having a front wall, a rear wall, and a side wall, the individual speakers being accommodated in the front wall, and the flat housing having a depth of less than 5 cm, or a diameter of a non-housed individual speaker of the two-dimensional array being smaller than 5 cm, and the two-dimensional array and the further array being arranged in a front wall of the housing such that they are in parallel, but eccentric, in relation to the edges of the front wall.

The present invention is based on the finding that a speaker which is inexpensive and flat while being of high quality may be achieved in that a two-dimensional array consisting of non-housed individual speakers, all of which have flat shapes, is arranged within a flat housing, said speaker having a large reproduction bandwidth or sufficient sound pressure within a desired narrow, e.g. low, frequency range.

This speaker is advantageous in that the space requirement is very small due to utilization of the flat individual loudspeakers, which typically also have small diameters. Due to the fact that the non-housed individual speakers are small and flat, even the housing volume that may be used per individual speaker is relatively small, so that the housing volume of the flat housing is so small that the entire speaker has a compact design. As an individual speaker, an element having low outdoor resonance is advantageous. In this case, the equivalent air volume will typically also be small. The rigidity of the diaphragm suspension of the individual speaker here is equated with the rigidity of an equivalent air volume. From that point of view, individual speakers having resonant frequencies of less than 150 Hz and, in particular, even less than 120 Hz or even less than 100 Hz are advantageous.

A further advantage of the present invention consists in that it enables utilization of flat, non-housed individual speakers, the housing volume that may be used being provided with almost any form factor, i.e. with a flat housing. In addition, utilization of non-housed individual speakers having flat form factors has the advantage that said individual speakers are available at very low cost and in large numbers. By arranging said non-housed individual speakers in a two-dimensional array, coupling of the speakers at low frequencies is exploited to generate sufficient sound pressure even at low frequencies, such as at 100 Hz. By contrast, utilization of small individual speakers, i.e. of individual speakers having comparatively small diaphragm diameters, is a great advantage, in particular at high frequencies, as compared to utilization of loudspeakers having relatively large diaphragms, since with small diaphragms, partial oscillations will occur only at higher frequencies, as compared to relatively large diaphragms.

A further advantage is that the many non-housed individual speakers and, thus, sub-areas of the two-dimensional array may be variably controlled. The intention is to achieve full-area exposure to sonic waves—which is largely independent on the location—as well as possible in the space in front of the speaker despite the fact that the speaker comprises an individual-speaker array having large dimensions.

Advantageously, the speaker includes exclusively identical individual speakers which may be headphone capsules or, in general terms, miniature sound transducers, for example. This results in that the manufacture of the loudspeakers is possible at a low price. In a further advantageous embodiment, the individual speakers are grouped into several arrays, the two-dimensional array comprising the single individual speakers being provided for low-frequency tone reproduction, and an array of one or more identical individual speakers being provided for high-frequency tone reproduction in case a two-way system is employed. Alternatively, a three-way system may also be implemented wherein the second array includes several mid-frequency speakers, and the high-frequency tone range is advantageously covered by a single or only a few individual speakers. However, a one-way system using non-housed flat individual loudspeakers will already provide good reproduction within a surprisingly large reproduction range.

In another embodiment it is advantageous to supply the two-dimensional array with the low-pass signal only, and to make the audio signal having the entire bandwidth available to the further array responsible for the mid-frequency or high-frequencies. This means that a frequency-separating means in this case will only have a low-pass function rather than a high-pass function.

In advantageous embodiments of the present invention, loudspeakers are obtained which enable—with identical individual speakers—reproduction of the frequency range from 100 Hz to 20 kHz with a sensitivity of at least 90 dB/1 W/1 m despite a flat speaker housing having a depth of less than 5 cm and, in particular, less than 3 cm. An advantageous embodiment includes 25 miniature sound transducers forming a two-dimensional array having a size of about 21×21 cm and comprising two sub-arrays for low-frequency tone reproduction and a line array for high-frequency tone reproduction, said line array being located between said two sub-arrays.

BRIEF DESCRIPTION OF THE DRAWINGS

Embodiments of the present invention will be detailed subsequently referring to the appended drawings, in which:

FIG. 6*b* shows technical data of the non-housed individual speaker of FIG. 6*a;*

DETAILED DESCRIPTION OF THE INVENTION

Figure 1B:
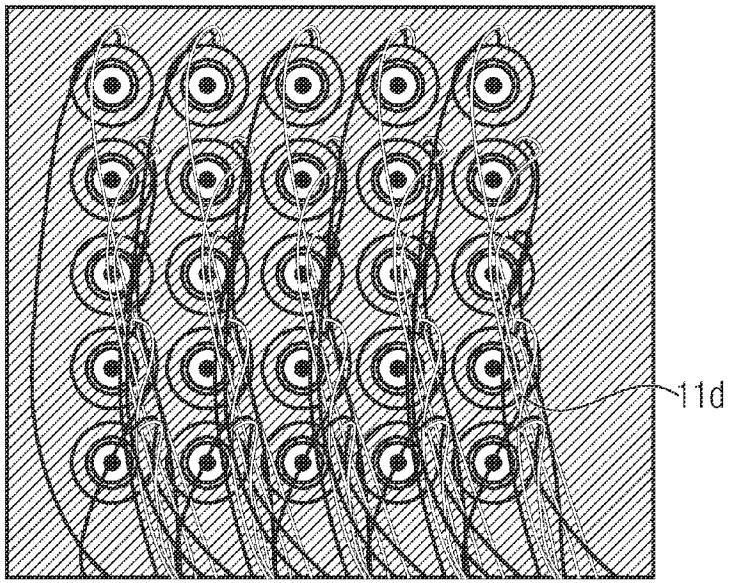
FIG. 1*b* shows a rear view of the speaker in accordance with a first embodiment of the invention.
Figure 1A:
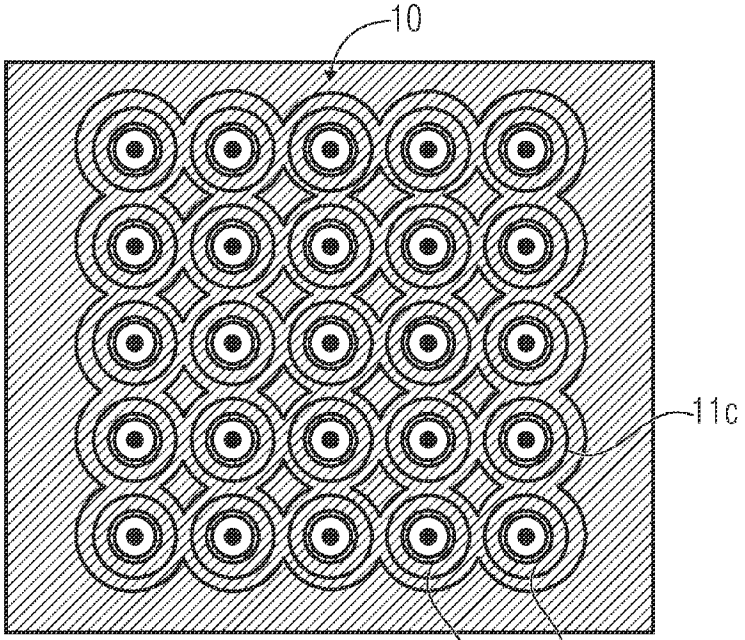
FIG. 1*a* shows a front view of a speaker in accordance with a first embodiment of the present invention.

FIG. 1*a* shows a front view of a speaker in accordance with an embodiment of the present invention. The speaker in FIG. 1*a* includes a two-dimensional array 10 consisting of non-housed individual speakers 11*a*, 11*b*, 11*c*, . . . , each non-housed individual speaker having a flat shape, as may already be seen in the rear view of FIG. 1*b* by way of example of the non-housed individual speaker 11*d*. In particular, the front view in FIG. 1*a* shows, per individual speaker, the front area, i.e. a plan view of the diaphragm of the speaker, whereas the rear view illustrates that the entire individual speaker is sufficiently flat to be accommodated within the housing shown in FIG. 1*b* and/or within the corresponding housing bore, and to hardly project beyond the bore. As may also be seen in FIG. 4*a*, with the non-housed individual speaker, which is employed in FIG. 1*b* and in FIG. 1*a* by way of example and is depicted in detail in FIG. 6*a*, the individual speaker is almost fully accommodated within the overall thickness of the material of the speaker front wall such that only a small section of the speaker projects beyond the housing front wall, and that, additionally, only a small section of the speaker projects from the housing front wall to the rear side, the projection from the housing front wall in one embodiment amounting to only 4.5 mm, and the loudspeaker projecting only about 1.5 mm on the rear side of the housing front wall, and is thus an extremely flat individual speaker.

Figure 6A:
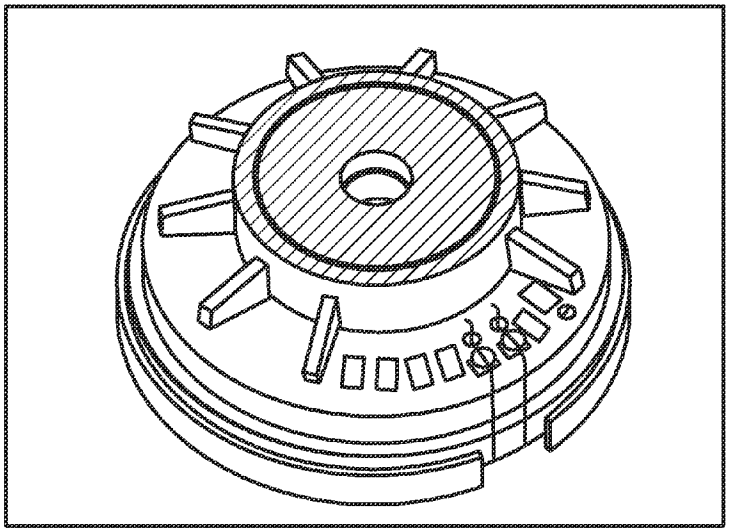
FIG. 6*a* shows a front view and a rear view of an advantageous non-housed individual speaker in the form of a headphone capsule.
Figure 6A:
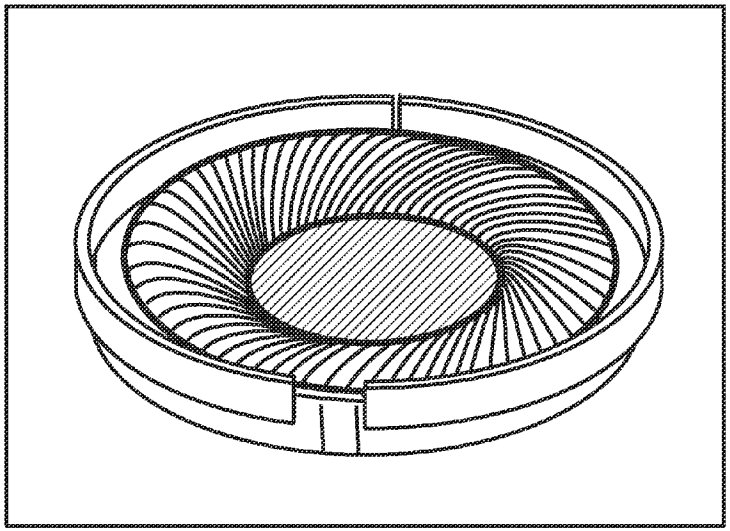

On account of the improved performance, however, it is advantageous to employ electrodynamic non-housed individual speakers that are basically designed like cone speakers. Cone speakers inherently have a system-related minimum depth. However, in particular with headphone capsules, this depth is very small, so that headphone capsules as are depicted in FIG. 6*a* and FIG. 6*b*, for example, having a very small depth, namely a design depth of only 10.6 mm, for example, are suitable and, additionally, are offered at low cost.

Figure 1C:
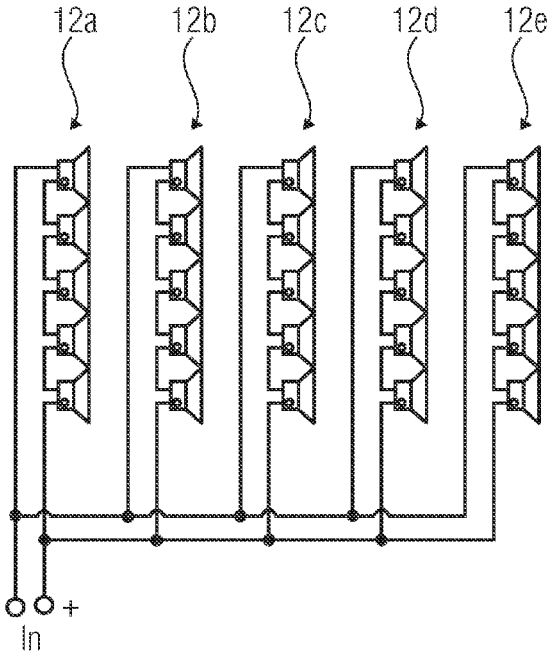
FIG. 1*c* shows a wiring connection of the non-housed individual speakers in accordance with an embodiment.

FIG. 1*c* shows control of the single non-housed individual speakers in FIG. 1*a* in the event of a 1-way implementation. In particular, at least two groups of at least two speakers each are formed from the non-housed individual speakers of the two-dimensional array, five groups 12*a*-12*e* being formed in the embodiment shown in FIG. 1*c*, each group having five individual speakers, so that the entire loudspeaker comprises a total of 25 non-housed individual speakers.

It is generally advantageous to provide speakers whose numbers of individual speakers vary between 9 and 49, the precise number of individual speakers depending on the individual conditions of the individual loudspeakers and on the sound pressure level that may be used, in particular within the lower frequency range, for which the speaker is designed.

In the embodiment shown in FIG. 1*a* and FIG. 1*b*, the diaphragm diameter of an individual speaker is 36 mm. In advantageous embodiments, such non-housed individual speakers are advantageous whose diaphragm diameters are smaller than 5 cm and advantageously even smaller than 4 cm, since with the inventive two-dimensional array arrangement, the performance within the high-frequency tone range improves as the diaphragm diameter of an individual loudspeaker decreases. Relatively small diaphragm areas, which are achieved by means of relatively small individual speakers, and utilization of non-housed individual speakers enable a more dense arrangement of the individual speakers so as to thereby reduce the overall size of the array. This results in reduced directivity. Moreover, partial oscillations, which may lead to marked spatial variations of the sound pressure level within the room, are shifted toward less critical higher frequencies. Even though said partial oscillations will also occur there, they will no longer represent a disturbance on account of the fact that they are no longer located at low frequencies.

The resulting drop in the sound pressure level at low frequencies is compensated for by a coupled arrangement of several individual speakers within the array, it being essential, however, that the individual speakers for low-frequency tone reproduction be arranged in a two-dimensional array rather than in a line array, for example. A two-dimensional array may use at least two adjacent rows, one row having to have at least two speakers, and the other row having to have at least one speaker. For example, a triangular arrangement consisting of speakers 11*a*, 11*b*, 11*c* in FIG. 1*a* already is a two-dimensional array, two-dimensional arrays in the forms of rectangles—squares or circles and/or ellipses being advantageous. In particular, a square array is most advantageous since the square shape best approximates the circular shape, and since the arrangement at right angles, as it were, of the single individual speakers, which results in an overall square for the two-dimensional array, enables the individual speakers to be located as close to one another as possible. In particular, the individual speakers are located so close to one another that they contact each other or that a direct distance of less than 5 mm and, in particular, less than 3 mm will exist between those individual speakers that are mutually adjacent.

The serial/parallel connection shown in FIG. 1*c* enables the entire speaker array to still have an appreciable ohmic resistance as compared to the situation where all of the speakers are connected in parallel, so that the current that flows does not exceed the power-handling capacity of the voice coils of the sound transducers. However, as compared to a full series connection of all of the single speakers, serial/parallel connection achieves that not all of the speakers connected in series will electrically influence one another. The serial/parallel connection in accordance with FIG. 1*c* thus represents a fair compromise between the complexity of the wiring connection of the individual speakers and the specifications for maximum current that are predefined by the individual speakers.

Figure 1D:
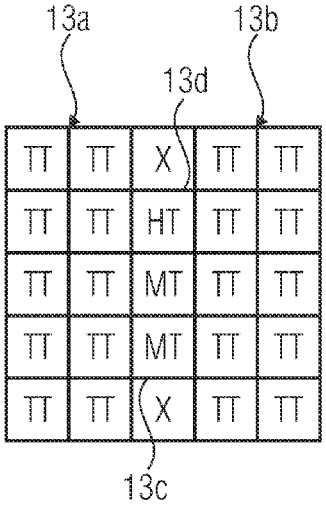
FIG. 1*d* shows a subdivision, in terms of frequency, of the array elements of FIG. 1*a* for three-way control.

FIG. 1*d* shows an alternative implementation of the embodiment shown in FIG. 1*a*, wherein the individual speakers are arranged similarly to FIG. 1*a*, but are controlled as a three-way system. Here, the two-dimensional array consisting of non-housed individual speakers is configured into a first array half 13*a* consisting of low-frequency tone speakers and a second array half 13*b* consisting of low-frequency tone speakers. These two array halves, or sub-arrays, are separated from a further array consisting of mid-frequency tone speakers 13*c*, and an even further array consisting only of one single high-frequency tone speaker 13*d*. In the implementation shown in FIG. 1*d*, the two individual speakers designated by "x" are short-circuited, i.e. deactivated, to the effect that said two individual speakers will not contribute to sound being output and that oscillation as a passive diaphragm may be prevented.

In the embodiment shown in FIG. 1*d*, one may recognize that the number of individual low-frequency tone speakers is considerably larger than the number of mid-frequency tone speakers or high-frequency tone speakers. This partitioning in favor of low-frequency tone reproduction is effected to provide sufficient sound pressure at low frequencies by coupling the individual loudspeakers for the low-frequency tone range, said coupling being achieved by arranging the individual low-frequency tone speakers as close to one another as possible within a two-dimensional array.

In accordance with the invention, reproduction of the frequency range from 100 Hz (−6 dB) to 20 kHz (−6 dB) with a sensitivity of 101 dB/1 W/1 m is enabled despite using a flat speaker housing of an internal depth of only 2.4 cm, and despite the resulting high spring rigidity of the air volume enclosed. To this end, an array sized 21 cm×21 cm is formed from 25 miniature sound transducers and is installed into a housing of the size (L×W×H). Controlling of the individual drivers is adjusted to the target of as linear an amplitude frequency response as possible and of uniform directivity in the main listening direction. To this end, the array is configured as a three-way system. The array approach is selected in order to implement as uniform a distribution as possible of the driving force to the diaphragm and to raise the occurrence of parallel oscillations to higher frequencies by means of many small diaphragm areas. However, in contrast to a large diaphragm area, the substantially smaller weights of the individual diaphragms are of great advantage for reproducing high frequencies.

It is in particular for wave field synthesis applications that the array approach offers the possibility of implementing the speaker distance between adjacent reproduction channels in a variable manner in that transducers may be arbitrarily grouped to form a reproduction channel. A boundary condition in wave field synthesis is "spatial sampling frequency", which may use—for non-aliasing reproduction of a tone of 1 kHz—one speaker element to be present every 17 cm, each said speaker element being controlled with a signal of its own. For 10 kHz the distance should be 1.7 cm; however, for 100 Hz it should be 1.7 m. A distance of 1.7 m may easily be accomplished. However, it is difficult or only roughly possible to accomplish a distance of 1.7 cm. The inventive flat-panel speaker enables supplying a low-pass-filtered signal to relatively large groups of individual speakers having relatively large widths. There will be advantageous synergy since individual speakers are useful anyway in a two-dimensional array in the low-frequency range to provide sufficient sound pressure. In contrast, neighboring groups or individual adjacent speakers are supplied with different speaker signals to generate—for the higher frequencies—a small channel distance which is in the order of magnitude of the diaphragm diameter. The speaker signal may be a high-pass signal or a signal having high-pass and low-pass components.

Advantageously, a further array of individual speakers will therefore be present, individual speakers of the two-dimensional array being grouped such that spatially adjacent wave field synthesis channels having limited bandwidths below 1 kHz may be reproduced by neighboring groups of individual speakers whose distances are larger than those between adjacent individual speakers or as compared to the groups of smaller grouplets, which reproduce spatially adjacent wave field synthesis channels having signal components above 1 kHz.

In accordance with the invention, a loudspeaker is obtained which comprises a linear frequency response across as large a frequency range as possible, exhibits good pulse response, uniform radiation behavior which is useful for the application, and is able to produce a maximum sound pressure level of 101 dB or more at a distance of 1 m while being exceptionally flat. The flat-panel loudspeaker is advantageous in that it may be inconspicuously incorporated in the surroundings and nevertheless has good transmission properties. The housing design is to be such that a particularly small installation depth of 5 and advantageously 3.6 cm or, even more advantageously, 3.0 cm, is not exceeded. To this end, acoustic drivers having very small installation depths are used. What is advantageous is the electrodynamic principle of cone loudspeakers as sound transducers, since this technology is readily controllable and performs well. The small installation depth that may be used necessitates utilization of miniature speakers and, consequently, small diaphragm areas. Thus, individual drivers are used in a group arrangement, it being possible in such a two-dimensional array—in contrast to an individual large bending-wave transducer and/or individual piston-type radiator having the same diaphragm area—to alter the respectively active radiator area by means of frequency-dependent controlling of the array elements, as need be. This option is advantageous with regard to avoiding the formation of side lobes at high frequencies and avoiding partial oscillations, the diaphragm radius being selected—if possible—such that partial oscillations will occur only at non-critical frequencies. A considerably larger diaphragm excursion and, thus, a higher loudness level may be achieved in the lower frequency range as compared to known thickness vibrators. Therefore, two-dimensional arrays are favorable for the inventive flat-panel speakers.

FIG. 6*a* shows a front view and a rear view of a advantageously utilized miniature speaker or "miniature chassis". The miniature chassis is advantageously implemented as a rearwardly open headphone capsule, as is shown in FIG. 6*a*. The parameters, determined by measurement, of such a non-housed individual speaker are indicated in the table in FIG. 6*b*. The outdoor resonant frequency of such an individual speaker is at 120 Hz.

Both in the speaker shown in FIG. 1*a* and in the speaker in accordance with a further embodiment of the present invention, the latter being discussed with reference to FIGS. 2*a*-2*e*, a closed housing is employed. In another advantageous embodiment, an open housing may also be employed, in particular with a bass reflex system, i.e. a bass reflex housing as a Helmholtz resonator as is known from the art.

As far as the material of the flat housing is concerned, a suitably rigid material is advantageous so as to obtain a sufficiently stiffened housing which may make do with a material thickness of less than 7 mm and, in particular, even with a material thickness of 3 mm or even less. It is advantageous to use sheet steel or profiled plastic as the material, even though wood may also be used. To minimize susceptibility to longitudinal and transverse modes of identical frequencies, it is advantageous for the edge dimensions of the overall speaker to not be in integer multiples of one another, or for the speaker to not have parallel walls. To nevertheless have a desired optical impression with parallel walls, an internal housing having non-parallel walls may be inserted into an external housing having parallel walls. An example of inner dimensions of the embodiment shown in FIG. 1*a* is a width of 61.5 cm, a height of 80 cm and a depth of 2.4 cm. When using an MDF sheet material of 6 mm, outer dimensions will result which comprise a width of 63.7 cm, a height of 81.2 cm and a depth of 3.6 cm.

To prevent the housing from co-vibrating, it is advantageous to insert, in the interior of the housing, ridges between the front and rear sides, and it is further advantageous to mount profiles onto the rear wall from outside. As may be seen, for example, in FIGS. 2*a*, 2*b*, it is advantageous to introduce the two-dimensional array in a central manner in terms of the width, and in a parallel manner in relation to the edges, but in an eccentric manner with regard to the height. The individual speakers are accommodated within individual bores, in particular, and are partly set back into the housing material. The individual speakers may be glued in, e.g. using hot-melt adhesive or any other sealing material, and be acoustically sealed off, in particular.

An advantage of the array arrangement is the possibility of differently controlling individual elements and, thus, individual sub-surfaces of the array. To be able to determine the active elements of the array in a frequency-dependent manner, multi-way control is advantageously used. To this end, the two-dimensional array as has been described by means of FIG. 1*d* is subdivided into two sub-arrays 13*a*, 13*b* for reproduction of low-frequency tones.

Alternatively to the embodiment shown in FIG. 1*d*, a two-way arrangement would consist in that in the central column, all of the speakers except for the single one located at the center are deactivated or non-existent, in which case the single central speaker would act as a single high-frequency speaker. To increase the maximally achievable sound pressure level, the three-way system shown in FIG. 1*d* is used. In order that the sound phases emitted by the three ways superimpose correctly, the mid-frequency tone branch is delayed, in particular, by 0.5 ms, and the high-frequency tone branch is delayed by 0.52 ms in relation to the low-frequency tone array.

Figure 2A:
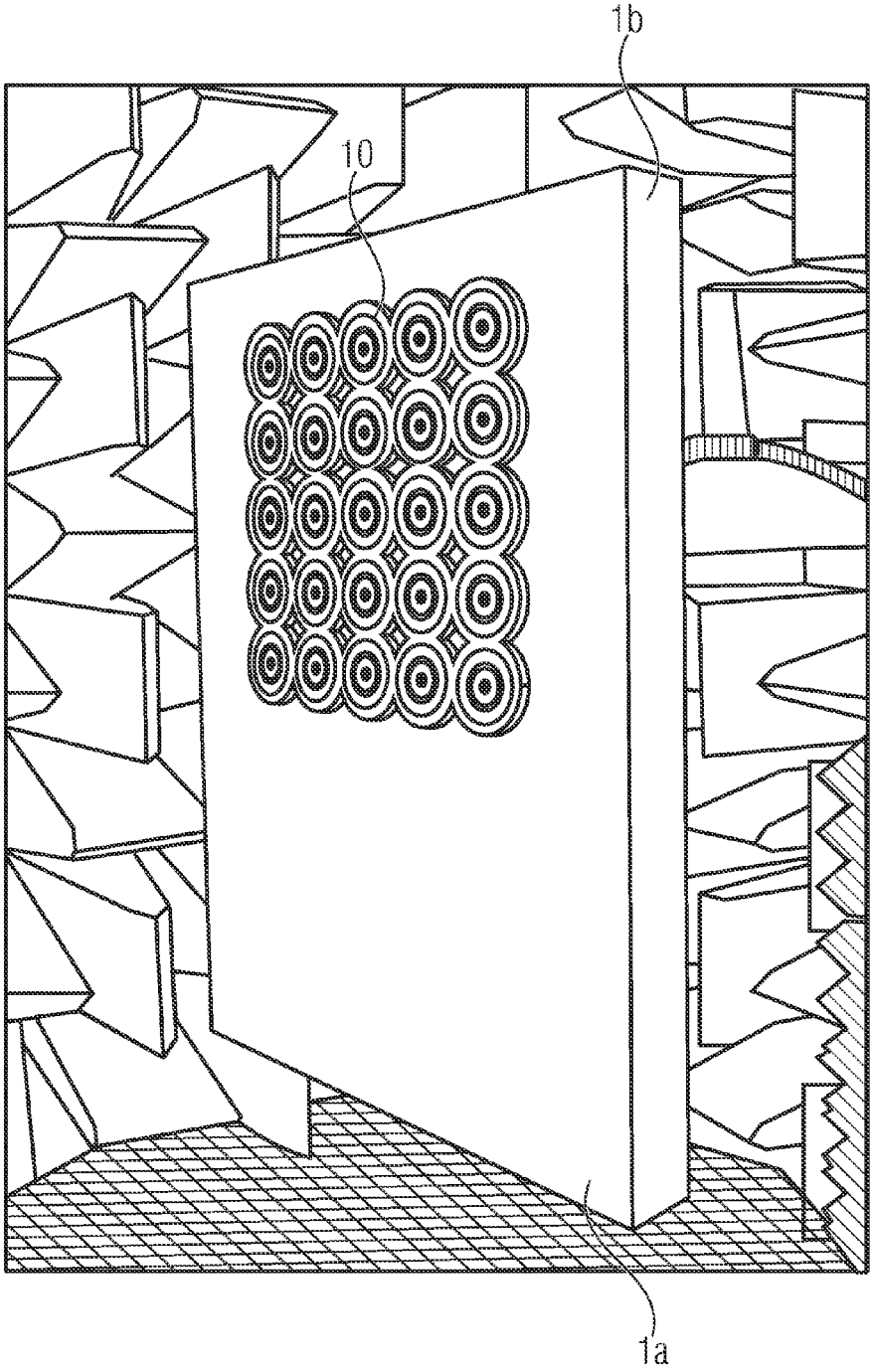
FIG. 2*a* shows a front view of a speaker in accordance with a second embodiment of the present invention.
Figure 2B:
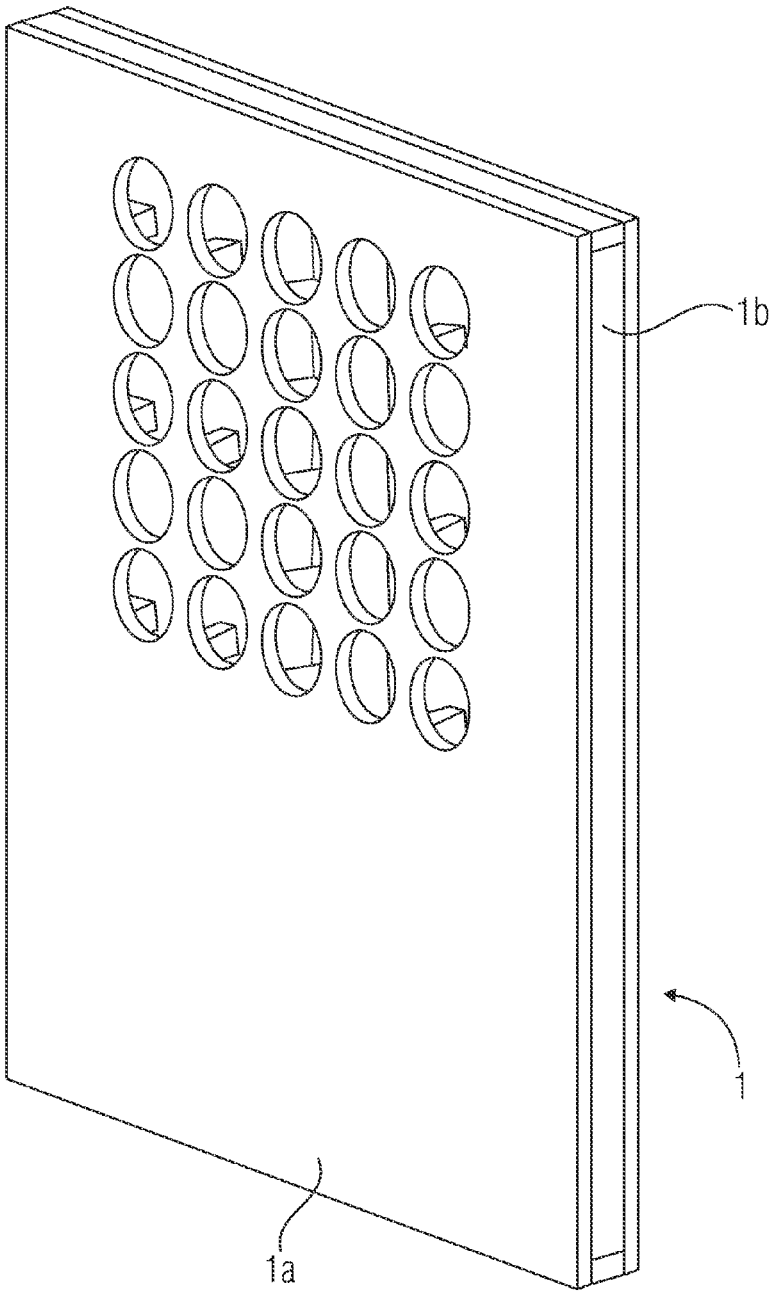
FIG. 2*b* shows a representation of the housing of the speaker of FIG. 2*a;*
Figure 2C:
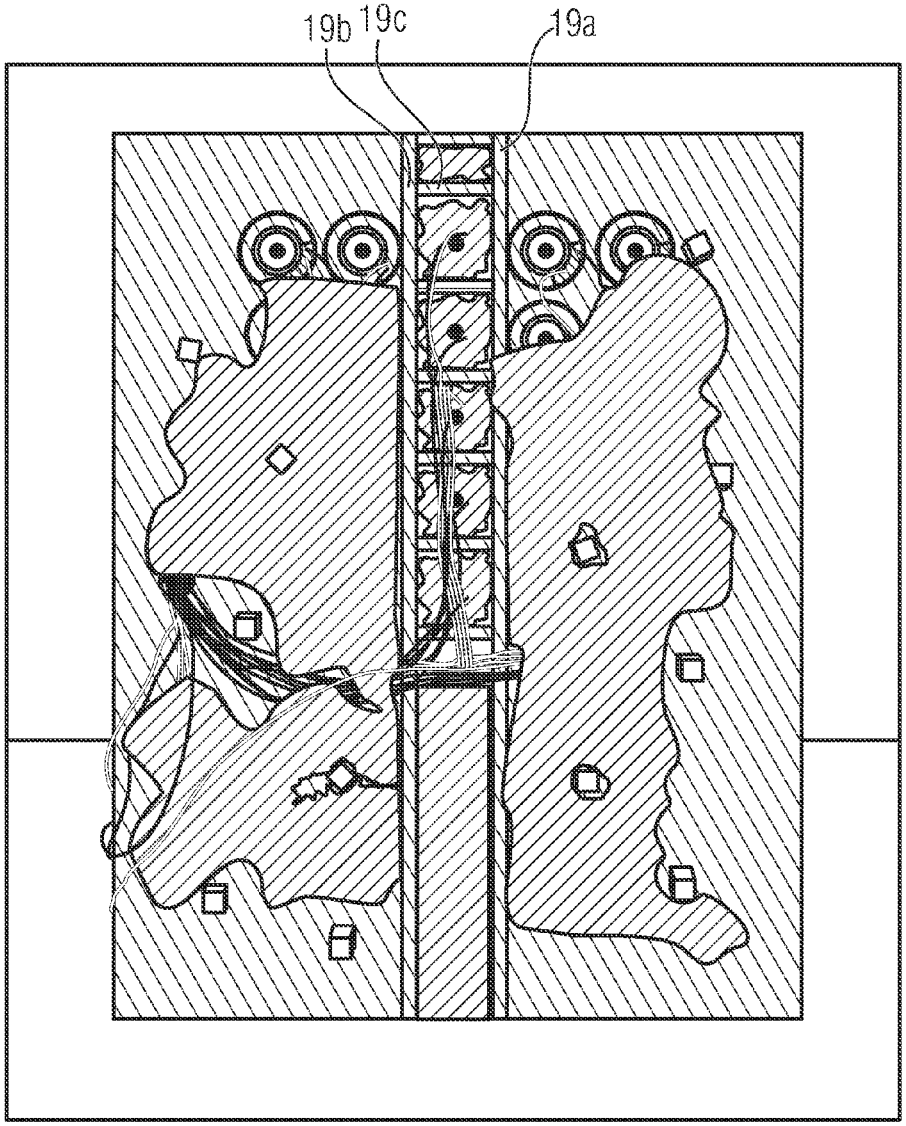
FIG. 2*c* shows a rear view of the speaker of FIG. 2*a* without any rear housing wall.
Figure 2D:
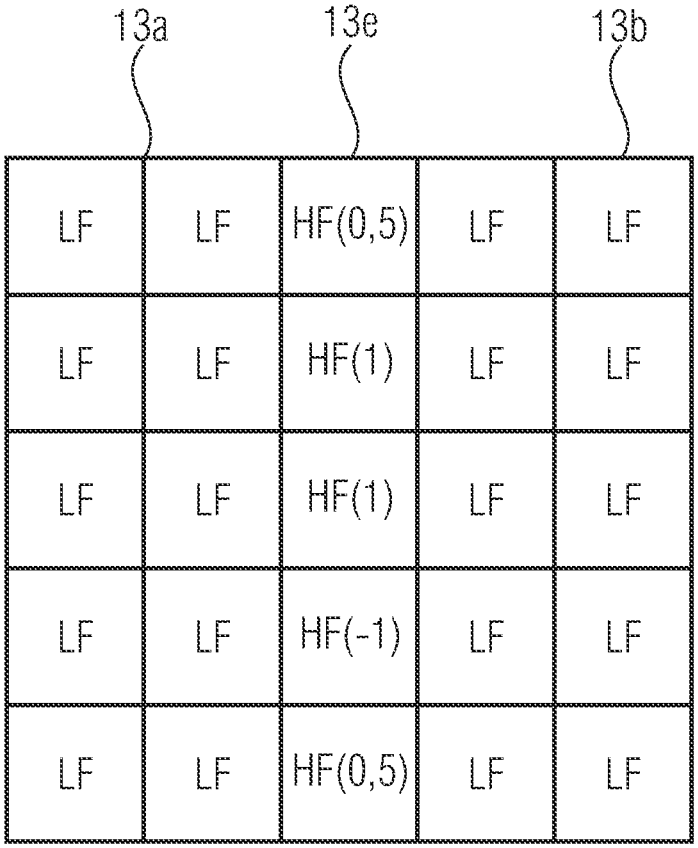
FIG. 2*d* shows a control configuration of the non-housed individual speakers for two-way control.

To further improve the radiation behavior, it is advantageous to use two-way control with a high-frequency tone path in the form of a Bessel-weighted linear array, as is schematically shown in FIG. 2*d*. Thus, suppression of focusing and of side lobe formation is improved. This effect is improved even more when, as is shown in FIG. 2*d*, the individual high-frequency tone speakers are arranged at the center and the two-dimensional array consisting of low-frequency tone speakers is subdivided into two sub-arrays 13*a*, 13*b*. However, in contrast to FIG. 1*d*, there is only one further high-frequency tone array 13*e* in FIG. 2, the individual high-frequency tone speakers being controlled with the weightings as are schematically indicated in FIG. 2*d*. It shall be pointed out that the weighting factors 0.5, 1, −1 have been obtained only due to a simple—in terms of circuit engineering—implementation of the Bessel weights, which computationally result as 0.11, 0.44, 0.76, −0.44 and 0.11, however, and can only be realized with a relatively large effort.

The control shown in FIG. 2*d* is effected such that the three individual speakers located at the center of the array 13*e* are controlled with a full amplitude, the lower one of said three individual speakers being controlled with an inverted phase, whereas the topmost individual speaker and the bottommost individual speaker of the array 13*e* are controlled with half an amplitude. Contrary to the factors calculated using Bessel functions, said level and phase conditions may be implemented with very simple means. Said amplitude conditions may be created by connecting the three central individual loudspeakers in parallel with a series connection of the loudspeakers at the very top and at the very bottom of the array 13*e*. In the individual speaker having a weighting factor "−1" in FIG. 2*d*, the phase is simply achieved by inverting the polarities of the terminal, as is shown at 15 in FIG. 3.

Similarly to FIG. 1*c*, the four columns of the low-frequency tone array are grouped into four groups of five individual speakers each, the groups being connected in parallel with one another. This results in a nominal impedance of 10 ohm for the high-frequency tone array and in a nominal impedance of 56 ohm for the low-frequency tone array. It would also be possible to connect all of the individual low-frequency tone speakers in parallel, in which case a higher current would flow through the voice coils, however. However, this might overload and destroy the voice coil wires of the individual speakers.

Figure 3:
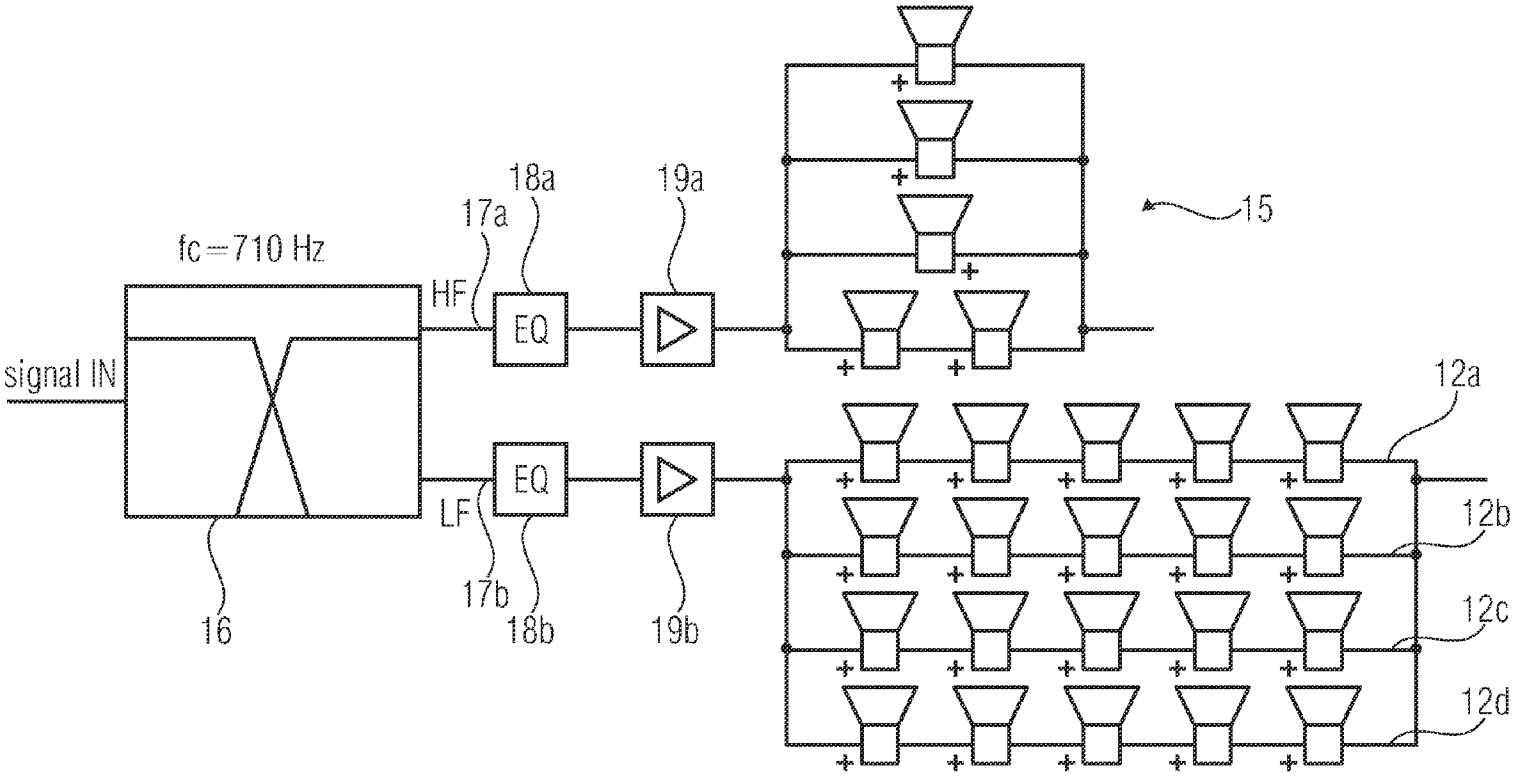
FIG. 3 shows a wiring connection of the non-housed individual speakers with additional drive electronics for the speaker control configuration shown in FIG. 2*d;*

As is depicted in FIG. 3, a frequency-separating means 16 having a cutoff frequency of 710 Hz is advantageous in the embodiment. In case of a larger array area, the frequency-separating means should have a lower cutoff frequency, and in case of a smaller array area, the frequency-separating means should have a higher cutoff frequency. Due to the frequency-separating means, a high-frequency tone path 17*a* and a low-frequency tone path 17*b* or, put in general terms, only a low-frequency tone path and a path having the full bandwidth exist instead of the high-frequency tone path, which has no low-frequency tone components, both of which are advantageously equalized by an equalizer EQ 18*a* and 18*b*, respectively, the equalized signals further advantageously being amplified by an amplifier 19*a* and 19*b*, respectively.

In the speaker shown in FIG. 2*a*, in accordance with the second embodiment of the present invention, a closed system is also used. The housing is based on a calculation using the so-called Thiele-Small parameters of the non-housed individual speakers, wherein the overall quality $Q_{tc}$ of the combination of the housing and the array should be 0.707. This tuning is also referred to as Butterworth tuning and expresses itself in a frequency response which, in the event of an ideal free-air frequency response, exhibits maximum smoothness, and in a minimally achievable resonant frequency.

FIG. 2*a* shows a perspective view of the speaker in accordance with the second embodiment with a housing front wall 1*a* and a housing side wall 1*b*, the speaker being arranged within a low-reflection room. The housing front wall includes a height and a width, the height being larger than the width, and it being advantageous to insert the array such that it is centered in terms of the width and parallel to the edges, and to accommodate the array not in a centered manner in terms of the height, but in a decentral manner, as is shown in FIG. 2*b*. FIG. 2*c* shows a rear view of the open speaker, ridges 19*a*, 19*b* being shown in the vertical direction, and ridges 190*c* being shown in the horizontal direction. Said ridges, which are advantageously implemented throughout from the housing front side to the housing rear side, enable capsulation of differently driven individual speakers. Pressure changes inside the speaker which are caused by vibrations of individual diaphragms would otherwise affect all of the individual speakers operating on the same volume. To avoid this, the individual speakers of the central array column operate on an individual demarcated volume in each case, which is achieved by the ridges 19*a*, 19*b*, 19*c*. Since these individual speakers are used for the high-frequency tone branch, i.e. since they are to operate far above their resonant frequencies, expensive dimensioning of the resulting volume is not necessary. The volume coupled to each individual high-frequency tone speaker is 0.0361 l. The dimensions of the volumes are determined on the basis of the dimensions of the individual speaker.

Figure 4A:
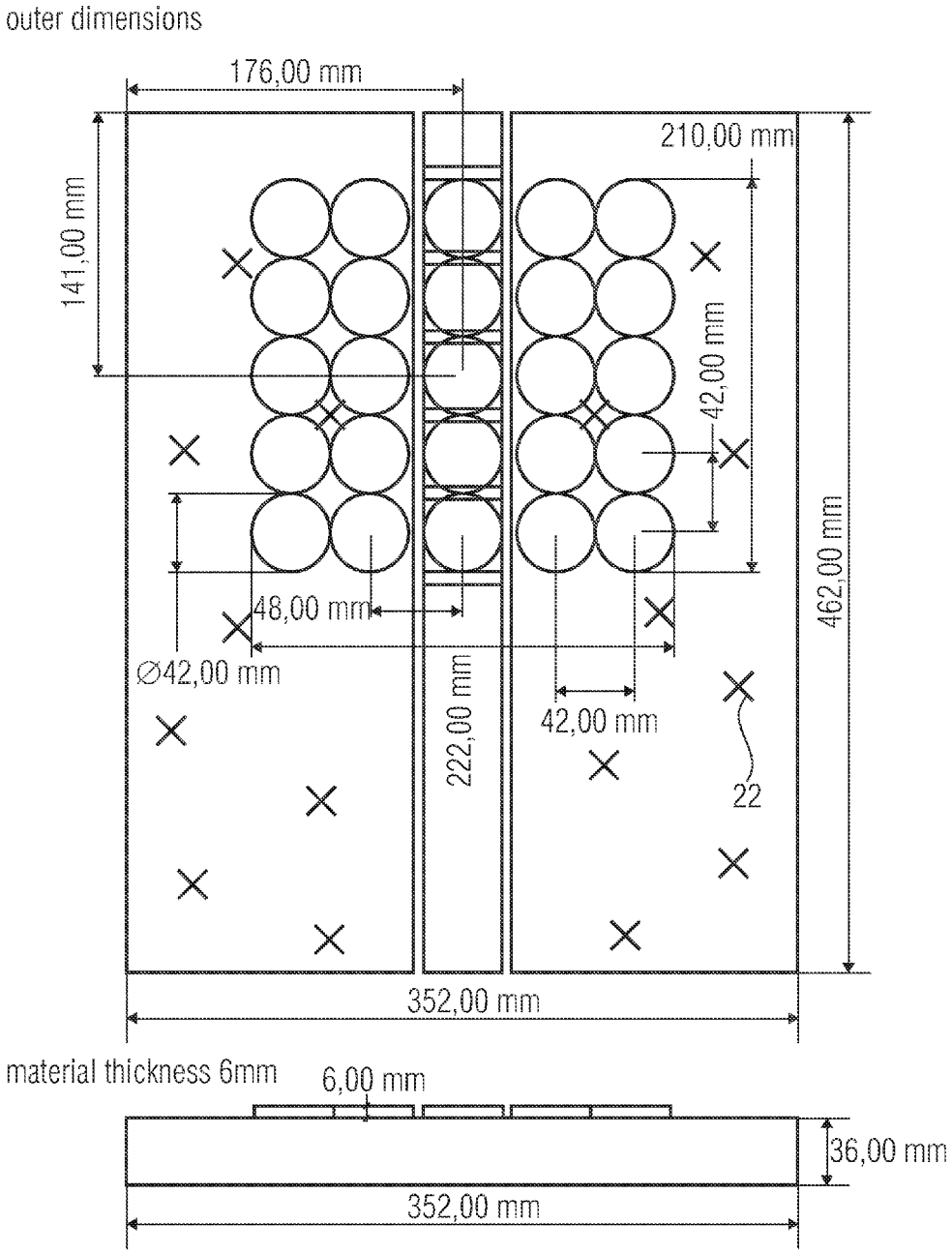
FIG. 4*a* shows a schematic representation of the flat housing of the speaker of FIG. 2*a*, FIG. 2*b* and FIG. 2*c;*
Figure 4B:
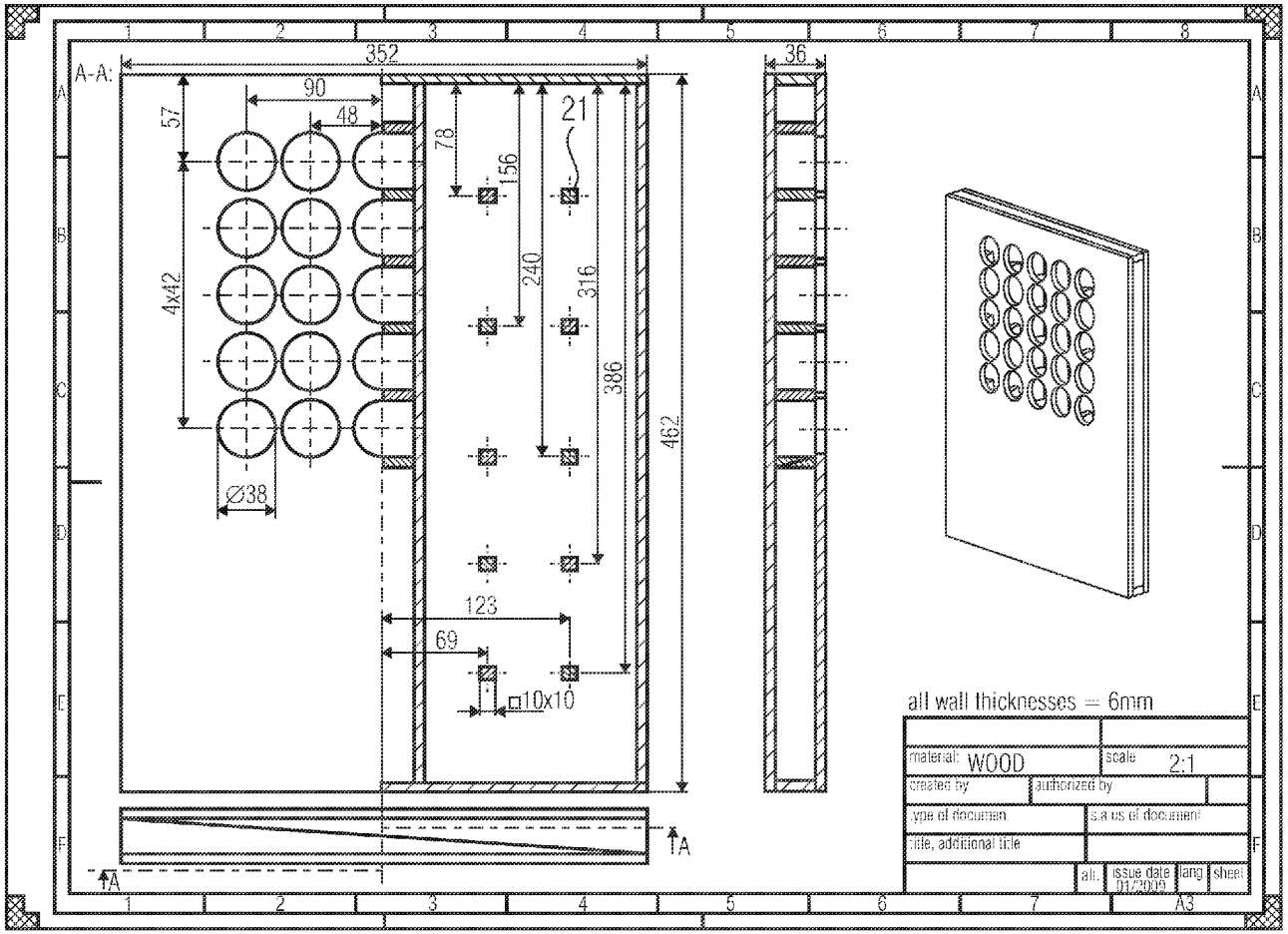
FIG. 4*b* shows an alternative schematic representation of the housing of the speaker of FIG. 2*a*, FIG. 2*b* and FIG. 2*c;*

The struts 19*a*, 19*b* achieve additional reinforcement of the housing and result in that the volume for the low-frequency tone array is partitioned into two chambers, as may be seen from FIG. 2*c* or also from FIG. 4*a* or FIG. 4*b*. Partitioning the overall volume into two chambers for the sub-arrays of the low-frequency tone speakers results in efficient reinforcement of the housing and in that bending vibrations of the housing front and/or of the housing rear wall and modes within the housing are suppressed to reduce corresponding negative influences on the performance of the speaker. Further reinforcement elements as are shown at 21 in FIG. 4*b* or 22 in FIG. 4*a* are inserted to improve the rigidity of the wood material used, said rigidity being relatively low. By minimizing the distances between the reinforcement points, co-vibration of the housing walls that is due to the high pressure that exists inside when the speaker is operated is prevented. Advantageously, the height and width of the housing are no integral multiples so as not to favor formation of simultaneous longitudinal and transverse modes. In the embodiment shown in FIG. 2*a* and/or FIG. 2*b*, the internal depth again is 2.4 cm. The outer dimensions of the embodiment shown in FIG. 2*a* amount to 35.2 cm in terms of width, to 46.2 cm in terms of height, and to 3.6 cm in terms of depth. Said outer dimensions are also indicated in the schematic drawing in FIG. 4*a* along with other advantageous dimensions of this embodiment.

Eccentric placement of the array on the front of the speaker is advantageous. The sound pressure of sound waves propagating from a sound source via a speaker front will change once they hit an edge, since the energy of the wave will split up into a changed volume. In the event of a housing edge, a sound wave will bend around the housing. The volume into which the sound wave propagates and the surface of the wave front become larger. The sound pressure acting on this surface becomes smaller. Due to the pressure change, a second sound source having an opposite phase will form at this edge. The sound emitted by said secondary sound source will superimpose with the sound emitted by the primary sound source. Depending on the run-time difference, which is influenced by the distance between the two sound sources and between the speaker and the listening position, constructive and destructive interference will alternately arise in the frequency response of the speaker. If the path difference equivalent to the run-time difference corresponds to integral multiples of a wavelength, minima will result at the corresponding frequencies, cambers will result with integral multiples of half the wavelength. If the array were placed centrally on the baffle, superposition of the interference phenomena would result for observation points near the 0° axis due to identical run times with regard to the right-hand side and left-hand side or upper and lower baffle edges. The result is a location-dependent frequency response which is partly characterized by heavy drops and cambers. To avoid this, the position of the array on the front plate is selected such that the distances from the central individual loudspeaker to the top, bottom and lateral housing edges are as different as possible and are no integral multiples of one another. Thus, coincidence—which would be disadvantageous—of interference effects is prevented.

Partitioning the housing into two equally sized chambers by means of reinforcement ridges involves that the array be arranged in a horizontally centered manner. For example, the distance from the center of the array to the lateral edges is 17.6 cm in each case. The distance from the center of the array to the topmost housing edge is determined to be 14.1 cm. The distance from the bottom housing edge thus is 23.1 cm. To prevent the strips, which in the embodiment have a thickness of 6 mm and are used for separating off the high-frequency tone drivers, from impeding air compression at the rearwardly open diaphragms, not all of the individual speakers of the array are arranged without a gap. Rather, a distance of 6 mm is provided between the individual speakers of the central column of the array and the individual speakers of the columns neighboring on the left- and right-hand sides, as may be seen from FIG. 4*a*.

It is advantageous to damp the housing with damping wool in order to avoid housing modes. A damping wool having a thickness of 3 cm and a mass of 280 g/m$^2$ may be employed. Energy is to be withdrawn from housing modes by being absorbed within the damping material, so that said housing modes cannot fully form, or cannot form at all. This principle works only for high sound velocity. Since there will invariably be pressure maxima and velocity minima at the edges of housings in the event of standing waves, no damping material is therefore introduced at the edges of the housing over a width of about 7 cm, as may be schematically seen in FIG. 2*c*.

Various measurements performed at the speaker explained in FIG. 2*a* to FIG. 2*d* in accordance with an advantageous embodiment will be explained below with reference to FIGS. 5*a*-5*d*.

Figure 5A:
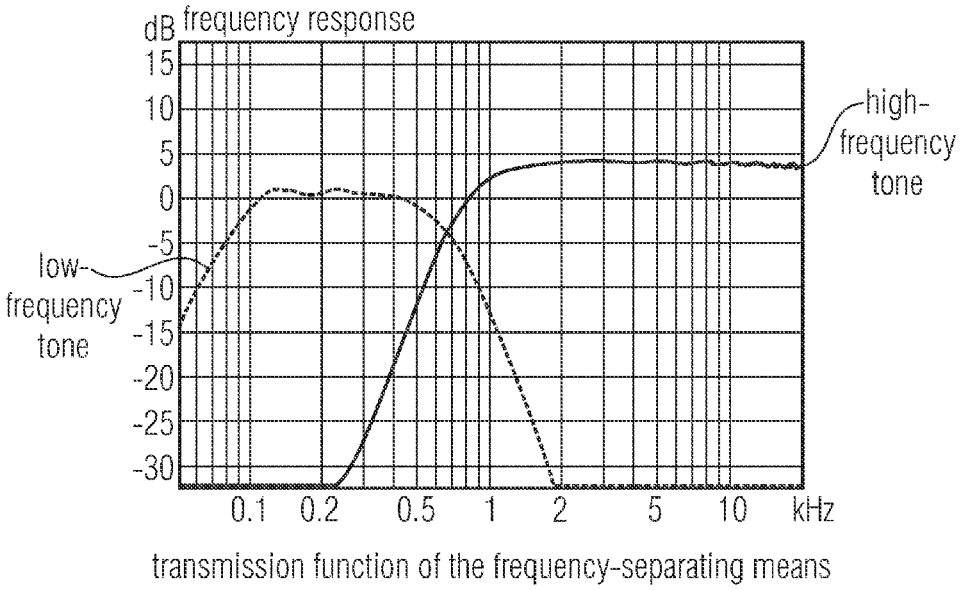
FIG. 5*a* shows a transfer function of a frequency-separating means for two-way control.
Figure 5B:
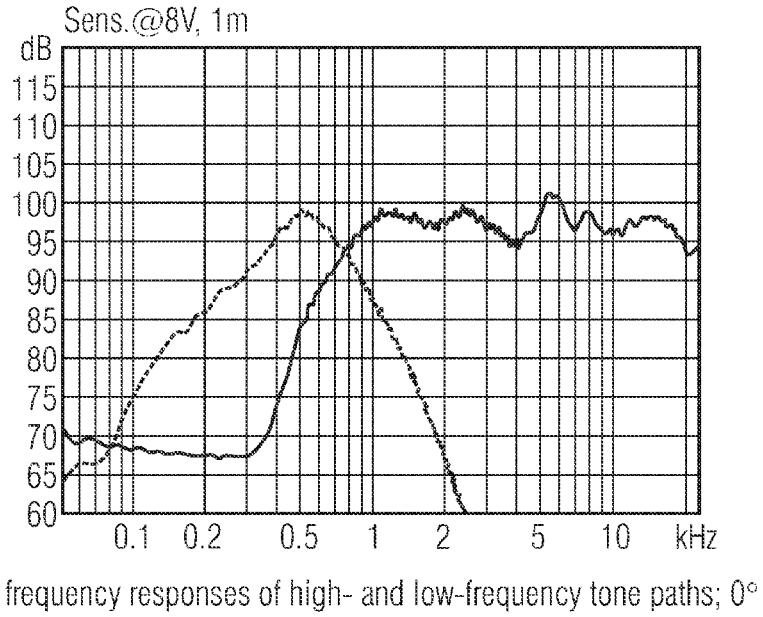
FIG. 5*b* shows the frequency responses of the high- and low-frequency tone path for the speaker shown in FIG. 2*a;*
Figure 5C:
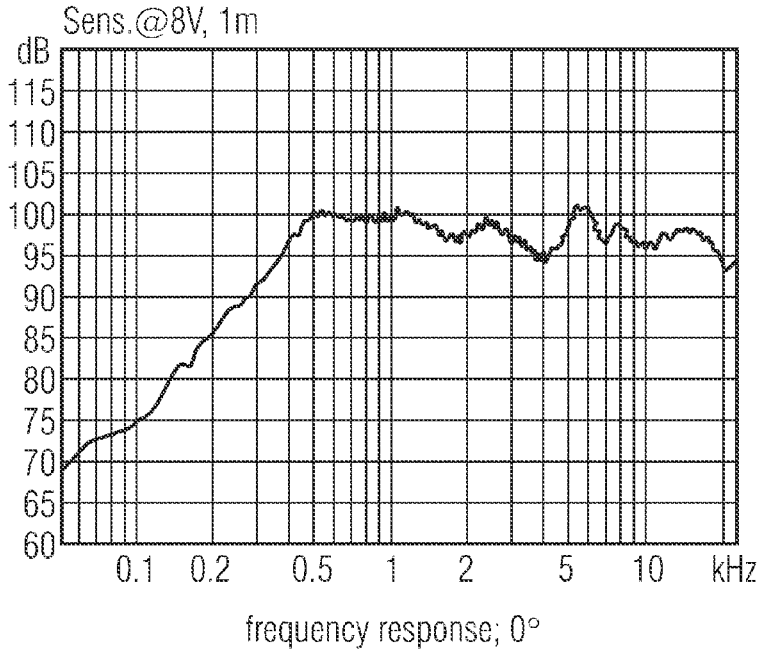
FIG. 5*c* shows a frequency response of the two-way speaker in accordance with FIGS. 2*a*-2*d* without any equalization.

Separation of the audio signals into a high-frequency tone branch and a low-frequency tone branch by the frequency-separating means 16 is performed with the help of fourth-order Linkwitz-Riley filters for the frequency-separating means. The transmission function of the frequency-separating means is depicted in FIG. 5*b*. The level of the high-frequency tone branch is elevated by 3 dB as compared to the low-frequency tone signal. The loudspeaker has an 80 Hz high-pass connected downstream from it, which is not shown in FIG. 3.

Figure 2E:
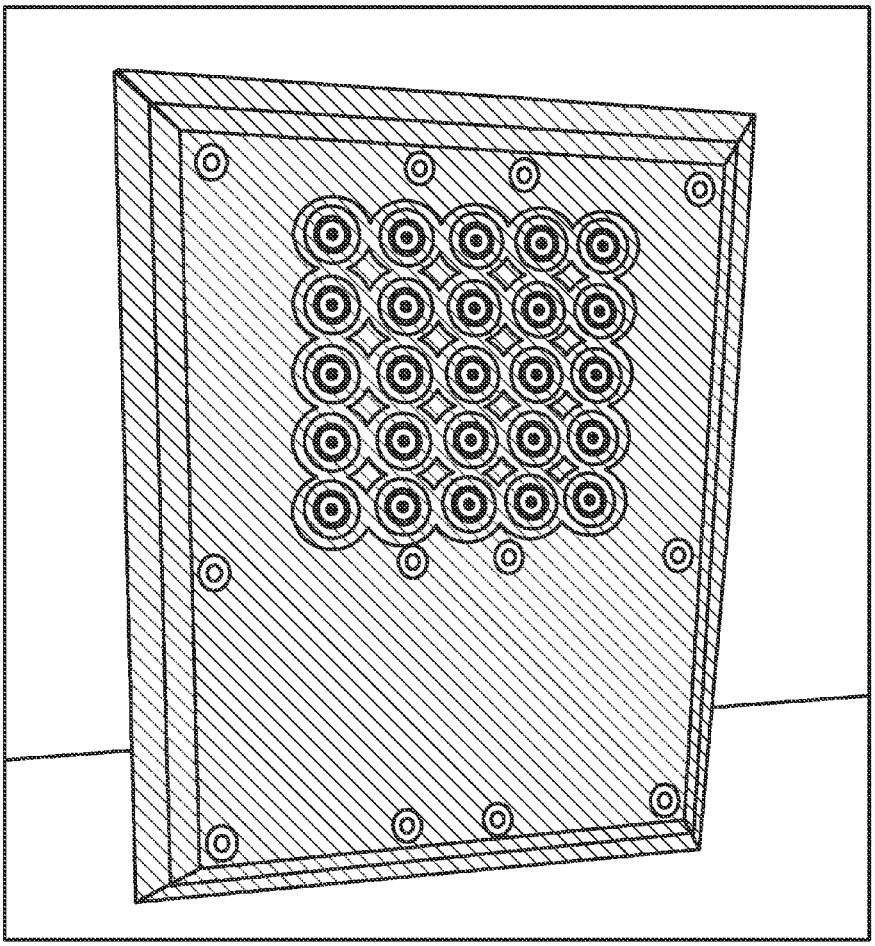
FIG. 2*e* shows an alternative implementation of the speaker of FIG. 2*a*, with beveled chamfers.
Figure 5D:
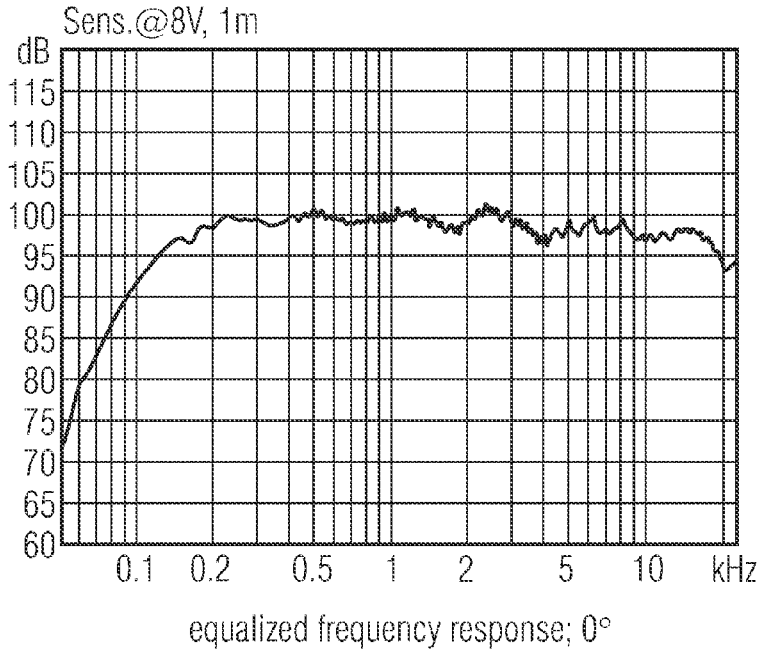
FIG. 5*d* shows an equalized frequency response of the speaker of FIG. 2*a* with control in accordance with FIG. 3.

The signal to which said filtering has been applied is supplied to the array. FIG. 5*b* shows the frequency responses of the high-frequency and low-frequency tone paths on the 0° axis. Acoustic summation of both paths results in the non-equalized frequency response shown in FIG. 5*c*. To approximate both the linearity of the frequency response and the lower frequency to the requirements, it is advantageous to perform equalization while using the equalizers 18*a*, 18*b*. FIG. 5*d* shows an equalized frequency response wherein a clearly better linearity may be seen and wherein, additionally, clearly improved performance in the lower frequency range and a reduced lower cutoff frequency have been obtained. So that the sound components emitted by both paths superimpose in as ideal a manner as possible in the overlap region, it is advantageous to delay the high-frequency tone path by 0.17 ms. The frequency response in the embodiment characterized by means of measurement technology in FIG. 5*d* is linearized in the range from 100 Hz to 20 kHz, so that a ripple of +/−2 dB may be achieved. At −6 dB, the cutoff frequency is 100 Hz. At 20 kHz, the sound pressure level also has decreased by 6 dB. The average electrical sensitivity of the speaker is 101 dB/1 W/1 m. As compared to conventional HiFi speakers, this value is high and is due to the high sensitivity of the non-housed individual speakers. FIG. 2*e* shows an alternative implementation of the flat housing with beveled chamfers so as to come closer to a housing front similar to a truncated pyramid in order to alleviate interference effects due to diffraction phenomena at the edges of the housing. Thus, an improved linear frequency response may be achieved.

To improve the sound pressure emitted by the loudspeaker at lower frequencies, i.e. around 100 Hz and below, in embodiments of the invention, the flat housing may be configured as a bass reflex housing which is not fully closed but has one or more openings in the baffle, which openings may also be extended into the housing as channels. The housing of a bass reflex system is a Helmholtz resonator with a closed installation opening for the sound transducer. The bass reflex channel has a mass of air located therein which, in the event of a resonance, vibrates with a maximum amplitude. The resonator is tuned to a resonant frequency below the resonant frequency of the sound transducer and will then make a major contribution, at low frequencies, to the sound radiation of the speaker. A correctly tuned bass reflex construction has an impedance curve with two neighboring maxima. The maximum sound pressure is emitted by the bass reflex tube at the minimum $f_b$ located between the two impedance maxima. The sound pressure emitted by the bass reflex channel decreases in the direction of higher and lower frequencies. The aim of tuning a bass reflex system is constructive superposition of sound components emitted by the sound transducer and the bass reflex opening. In an advantageous embodiment, a bass reflex opening is provided on the lower side wall of the housing shown in FIG. 2*b*, for example, said channel opening being configured to be rectangular and to have a width of 5 cm. The length of a reflex tube for a chamber will then be 3.3 cm, for example. A housing optimized in these terms will have a dimension of 41.5 cm in terms of width, of 66.2 cm in terms of height, and of 2.4 cm in terms of depth, said dimensions referring to the internal dimensions. The opening of the bass reflex channel may be enlarged in other embodiments, specifically it may be enlarged to cover the entire width of a chamber of, e.g., 17.2 cm. Accordingly, the reflex tube length may be increased, since the length may also be increased as the area of the opening increases, if the tuning frequency is to be maintained.

In a different implementation, the reflex opening may also be arranged at the upper narrow end of the housing.

In particular, a closed speaker having a two-dimensional arrangement of 25 miniature speakers as sound transducers is advantageous, it being possible for the number of sound transducers to also range from 9 to 49, depending on the application. A square shape of the arrangement of the sound transducers is advantageous; the two-dimensional array is to advantageously operate in separated volumes while being subdivided into separate sub-arrays of the individual speakers providing the critical low-frequency tone range. A symmetrical two-way arrangement is advantageously employed; the individual loudspeakers of the further array located between the two sub-arrays operating as high-frequency speakers are weighted by coefficients of Bessel functions. The excitation signal of the system is equalized using a speaker controller and is actively separated and amplified by means of two output stages. Thus, values that are common in HiFi are achieved both for the maximally achievable sound pressure level and for the ripple of the frequency response and the harmonic distortion. The speaker is characterized by a continuous, not excessively focusing directional characteristic without any side lobes.

Speakers in accordance with the present invention may be employed both in classical stereo or multi-channel setups, advantageously with a sub-woofer for the lowest frequency range. The array concept leads to high scalability of the system. Thus, with loudspeaker panels for wave field synthesis, the distance of neighboring reproduction channels may be minimized due to the small diameters of the individual speakers. Because of the possibility of discretely controlling single non-housed individual speakers and, thus, specific areas of an array, temporally modifiable control operations may also be used. The bundling effect of the speaker in the vertical plane above 10 kHz may be further reduced by means of modified array controlling if only one single speaker is operated above 10 kHz. In accordance with the directivity of the single speaker, the vertical radiation angle above 10 kHz may be increased by using such a three-way system. The sound pressure camber in the frequency response of the miniature driver used in the embodiments is advantageously eliminated in order that no more equalization will be necessary.

For utilization of the speaker that is non-critical in terms of real time, it is advantageous to use a linear-phase set of filters for equalization. Thus, the group run time of the system consisting of speaker(s) and a controller may be positively influenced.

To improve the speaker at lower frequencies, it is advantageous—rather than to increase the array area—to increase the emitted sound pressure by increasing the diaphragm excursion. If the diaphragm excursion is doubled, the sound pressure emitted will ideally also double. To this end, however, the mechanics of the sound transducer may be configured for increased excursion. The force generated by the drive of an electrodynamic sound transducer is determined by the product of the magnetic flux density B of the magnet, the length l of the coil wire, and the current I flowing within the coil.

Advantageously, the inventive speaker is implemented, on a DSP, as an active speaker comprising internal signal processing since a (e.g. active) frequency-separating means and equalization as well as multi-channel amplification may be employed and incorporated into the speaker housing.

The inventive speaker is characterized by an exceptionally small housing depth, by inexpensive manufacturability and by convincing values both in terms of measurement technology and at a subjective level.

Figure 7A:
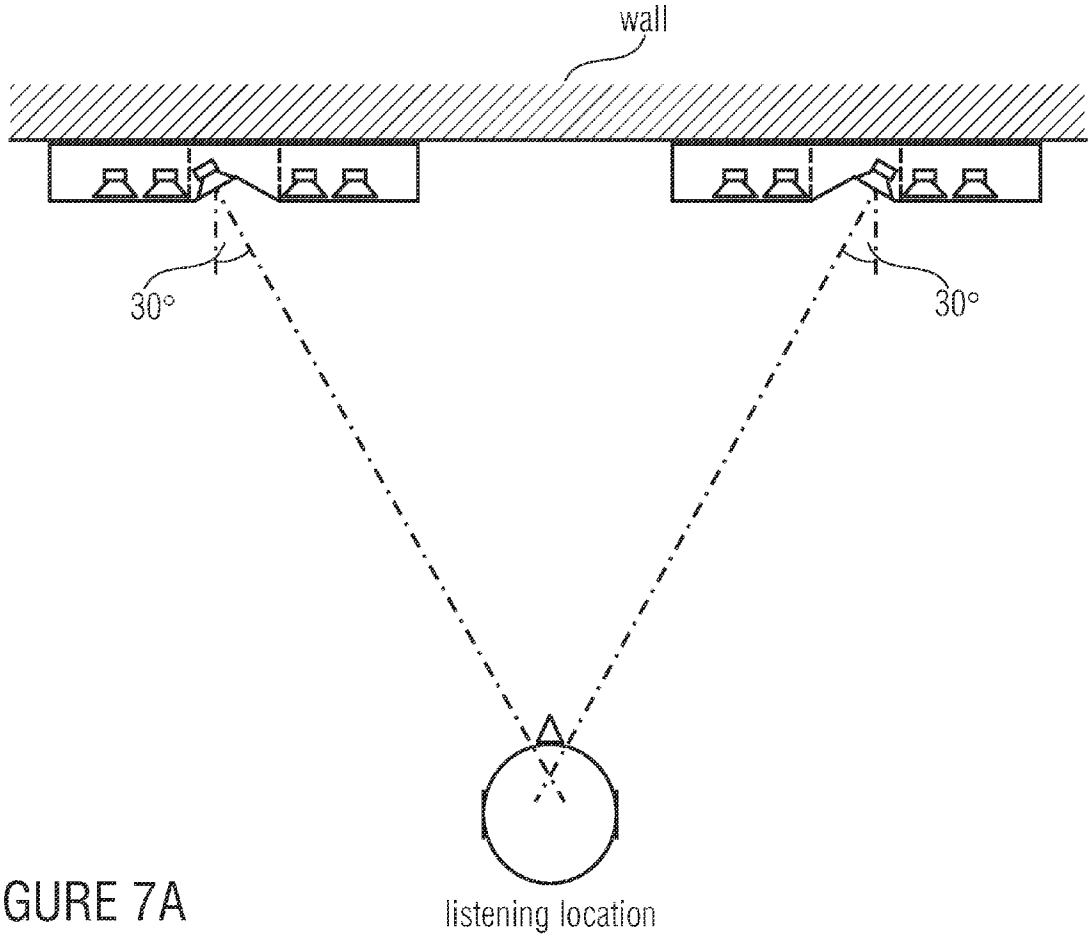
FIG. 7*a* shows a schematic representation of a field of application for flat-panel speakers having high- and/or mid-frequency range speakers arranged in a mutually tilted manner.

FIG. 7*a* shows a speaker wherein a further array of individual speakers advantageously exists at the center of the speaker, wherein one or more individual speakers are arranged in a tilted manner in relation to the individual speakers of the two-dimensional array, so that a surface normal to an active area of an individual speaker of the further array differs from a surface normal to an active area of an individual speaker of the two-dimensional array. The tilt may amount to, e.g., 30 degrees relative to the normal and advantageously ranges from 10° to 70°. In this case, a listener may have the speaker oriented toward him/her, even if the flat-panel speaker is mounted on the wall and cannot be rotated. However, alignment is not required for an approximately omnidirectional characteristic of the low-frequency tone array.

Figure 7B:
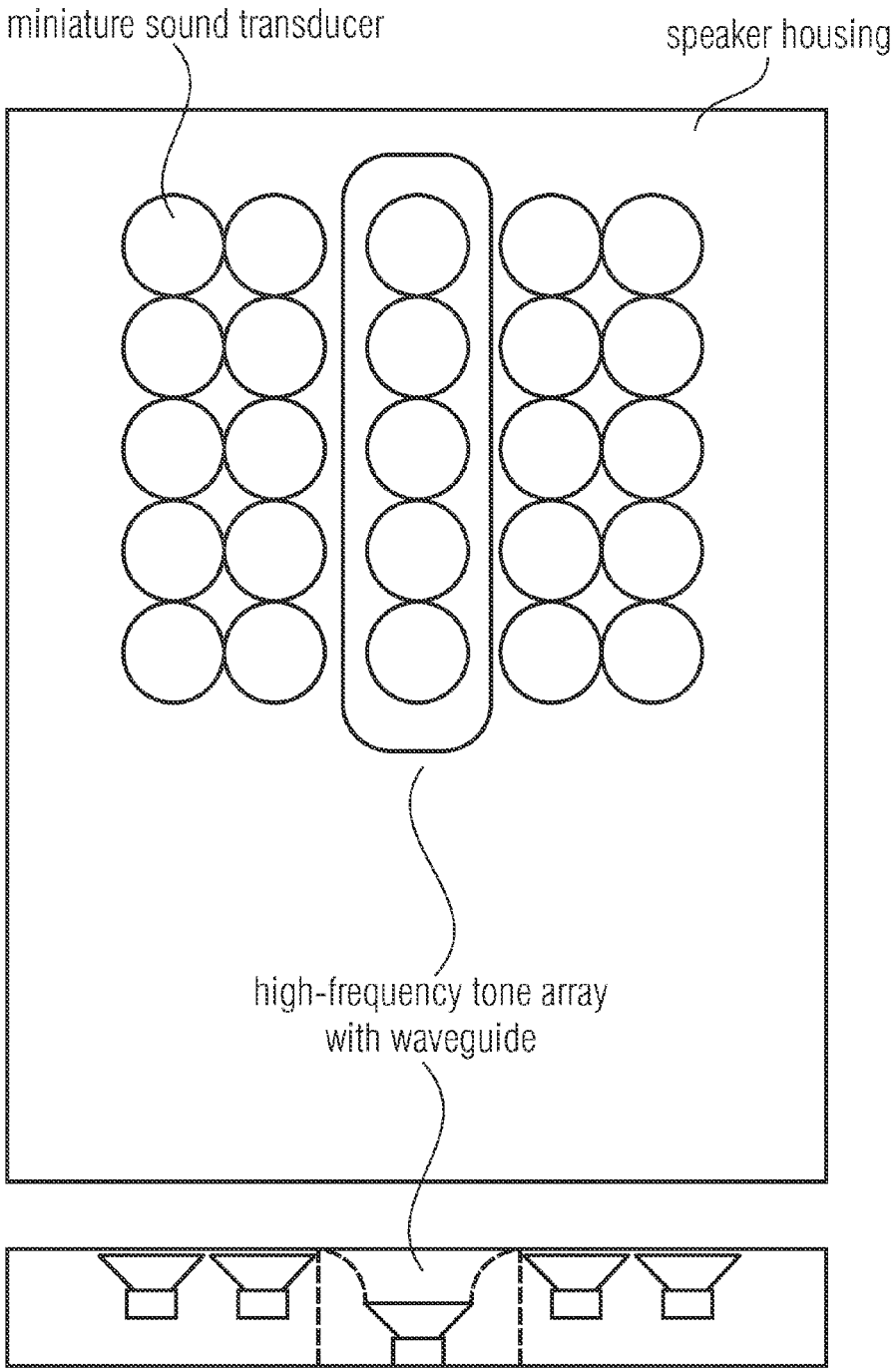
FIG. 7*b* shows a schematic representation of a speaker having a set-back mid- or high-frequency tone array with a horn or wave guide for homogenizing the directivity pattern of the mid- or high-frequency tone array.

FIG. 7*b* shows a speaker wherein a further array of individual speakers exists which is set back within the housing or which has a waveguide means in front of the active area. Advantageously, a setback and a waveguide structure are used for having a planar surface of the speaker. In addition, the setback of the high-frequency speakers at the center is uncritical since the air volume that may be used for the high-frequency speakers is small or, on the whole, irrelevant, due to the high frequencies. The waveguide structure serves to homogenize the inherent directivity in the region intended and will have a horn-type shape.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A loudspeaker comprising:

an array comprised of non-housed individual speakers comprising flat shapes, the array being formed in the shape of a square and comprising a two-dimensional array comprised of a first two-dimensional sub-array and a second two-dimensional sub-array, the array further including a line array of flat-shaped individual speakers arranged between the first two-dimensional sub-array and the second two-dimensional sub-array in the form of a central array column of the array, the central array column including only a single line of the flat-shaped individual speakers;

a frequency-separator configured to provide a high-pass signal via a high-frequency tone path and a low-pass signal via a low-frequency tone path, the high-pass signal being used for controlling the line array and the low-pass signal being used for controlling the first and second sub-arrays, all of the individual loudspeakers of the first and second sub-arrays being wired such that they are controlled via the low-frequency tone path by control signals that exhibit no mutual phase-shift apart from different line lengths, no phase shifter existing between the individual speakers and a driver output of the low-frequency tone path, and the individual speakers of the first and second sub-arrays being configured to provide low-frequency tone range in a multi-way system; and a flat housing accommodating the individual speakers, the flat housing including a front wall, a rear wall, and a side wall, wherein the flat housing has a depth of less than 5 cm, a diaphragm diameter of a non-housed individual speaker of the two-dimensional array is smaller than 5 cm, a distance between edges of the non-housed individual speakers that are mutually adjacent is smaller than 5 mm, a number of the non-housed individual speakers is between 9 and 49, and the loudspeaker is configured to emit sound at least in a frequency range between 100 Hz and 10 kHz.

2. The loudspeaker as claimed in claim 1, wherein a smallest distance of an individual speaker of the line array from an individual speaker of the two-dimensional array is larger than a smallest distance between two directly adjacent individual speakers of the two-dimensional array.

3. The loudspeaker as claimed in claim 1, wherein an equalizer and/or an amplifier are provided for the high-pass signal and/or the low-pass signal, said equalizer and/or amplifier being configured to homogenize a frequency response of a sound output of the loudspeaker within a predefined frequency range.

4. The loudspeaker as claimed in claim 1, wherein the housing comprises, in its interior, one or more ridges for connecting a front wall and a rear wall of the flat housing, said at least one ridge being arranged such that it is arranged between an individual speaker of the two-dimensional array and an adjacent individual speaker of the line array.

5. The loudspeaker as claimed in claim 1, wherein the two-dimensional array is eccentrically arranged in a front wall of the housing such that a center of the two-dimensional array differs from a center of the front wall by at least 10% of the shorter side of the front wall.

6. The loudspeaker as claimed in claim 1, wherein a number of individual speakers in the two-dimensional array is at least double the number of those in the line array.

7. The loudspeaker as claimed in claim 1, wherein the two-dimensional array comprises at least two groups of individual speakers, each group comprising at least two individual speakers, the individual speakers within a group being serially connected, and the groups being connected in parallel.

8. The loudspeaker as claimed in claim 2, wherein the line array is a Bessel-weighted line array of speakers, and a control circuit exists which is configured to provide outer individual speakers of the Bessel-weighted line array with a driver signal that is weaker, in terms of amplitude, than that of a central speaker of the Bessel-weighted line array.

9. The loudspeaker as claimed in claim 1, wherein all of the individual speakers of the two-dimensional array or all of the individual speakers of the loudspeaker overall comprise identical active areas.

10. The loudspeaker as claimed in claim 1, wherein all of the individual speakers of the two-dimensional array or all of the individual speakers of the entire loudspeaker are electrodynamic speakers.

11. The loudspeaker as claimed in claim 1, wherein all of the individual speakers of the two-dimensional array or all of the individual speakers of the entire loudspeaker are cone loudspeakers or piston-type radiators.

12. The loudspeaker as claimed in claim 1, wherein all of the individual speakers of the two-dimensional array or all of the individual speakers of the entire loudspeaker are headphone capsules.

13. The loudspeaker as claimed in claim 1, wherein the speakers are arranged within the housing such that there is at least a distance of 0.8 cm and at the most a distance of 4 cm between a rear side of a diaphragm of each individual speaker of the two-dimensional array and a nearest housing wall.

14. The loudspeaker as claimed in claim 1, wherein the individual speakers of the two-dimensional array are arranged sufficiently close to one another so that edges of adjacent individual speakers are spaced apart less than 3 mm or contact one another.

15. The loudspeaker as claimed in claim 1, wherein the first and second sub-arrays each comprise two adjacent rows of individual speakers, and the further array comprising a single row of individual speakers, a number of the individual speakers per row being identical for all rows and arrays.

16. The loudspeaker as claimed in claim 1, wherein the housing is sufficiently large as to comprise a volume which is equal to a minimum volume that may be used per individual speaker of the two-dimensional array multiplied by the overall number of individual speakers of the two-dimensional array.

17. The loudspeaker as claimed in claim 1, wherein a depth of the flat housing is less than 1/10 of the shorter side of a front wall or rear wall of the housing.

18. The loudspeaker as claimed in claim 1, wherein an equalizer is provided for the high-pass signal and the low-pass signal, respectively.

19. The loudspeaker as claimed in claim 1, wherein the housing comprises a continuous partitioning so as to provide a first housing volume for the first sub-array and to provide a second housing volume for the second sub-array, the first housing volume and the second housing volume being separated from each other by the partitioning.

20. The loudspeaker as claimed in claim 1, wherein the further array of individual speakers is set back within the housing or which comprises a waveguide in front of the active area.

21. The loudspeaker as claimed in claim 1, wherein one or more individual speakers are arranged in a tilted manner in relation to the individual speakers of the two-dimensional array, so that a surface normal to an active area of an individual speaker of the further array differs from a surface normal to an active area of an individual speaker of the two-dimensional array.

22. The loudspeaker as claimed in claim 1, wherein the non-housed individual speakers of the line array are controlled in a manner delayed by 0.17 ms as compared to the first and second sub-arrays.

23. A loudspeaker comprising:

a two-dimensional array comprised of non-housed individual speakers comprising flat shapes, said two-dimensional array comprising a first two-dimensional sub-array and a second two-dimensional sub-array;

a further array comprised of individual speakers comprising flat shapes, said further array being arranged along a width of the front wall between the first two-dimensional sub-array and the second two-dimensional sub-array, the further array including only a single line of the flat-shaped individual speakers;

a frequency-separator for providing a high-pass signal and a low-pass signal, the high-pass signal being used for controlling the further array and the low-pass signal being used for controlling the two-dimensional array; and a flat housing including a front wall, a rear wall, and a side wall, the individual speakers being accommodated in the front wall, wherein the flat housing has a depth of less than 5 cm, a diameter of a non-housed individual speaker of the two-dimensional array is smaller than 5 cm, the two-dimensional array and the further array being arranged in a front wall of the housing such that they are in parallel, but eccentric, in relation to the edges of the front wall.

24. The loudspeaker as claimed in claim 23, wherein the two-dimensional array and the further array are arranged such that a center of the two-dimensional array differs from a center of the front wall along the height by at least 10% of the length of the front wall in the direction of the height.

25. The loudspeaker as claimed in claim 23, wherein the two-dimensional array and the further array are centrally arranged with regard to the width.

* * * * *